US006170666B1

(12) United States Patent
DesLauriers

(10) Patent No.: US 6,170,666 B1
(45) Date of Patent: Jan. 9, 2001

(54) TRAY PACKAGING AND DISPLAY SYSTEM

(75) Inventor: Gary M. DesLauriers, Batavia, IL (US)

(73) Assignee: DesLauriers International, Inc., Batavia, IL (US)

( * ) Notice: Under 35 U.S.C. 154(b), the term of this patent shall be extended for 0 days.

(21) Appl. No.: 09/300,611

(22) Filed: Apr. 27, 1999

(51) Int. Cl.[7] ..... B65D 73/00
(52) U.S. Cl. ..... 206/756; 206/467; 206/471
(58) Field of Search ..... 206/756, 461, 206/467, 469, 745, 737, 765, 769, 770, 771, 471

(56) References Cited

U.S. PATENT DOCUMENTS

| | | | | |
|---|---|---|---|---|
| 4,854,450 | | 8/1989 | Fosjer | 206/469 |
| 4,901,858 | * | 2/1990 | Anderson | 206/471 |
| 5,143,215 | * | 9/1992 | Hartley et al. | 206/467 X |
| 5,429,241 | * | 7/1995 | Althaus | 206/471 |

OTHER PUBLICATIONS

Form, Fill & Seal Machines brochure, Arlington Pac Inc.
Dixie Line brochure, Dixie Union Packaging Systems.
Pure and Simple brochure, RapidPak, Jun. 1997.
Pure and Simple brochure, RapidPak.
Classic Stoneware Trays brochure, Tenneco Pressware Packaging.
THE STAR TWO S brochure, DellepaC.
Performed Tray Machine brochure, INPACK, Ross Industries, Inc., 1992.

* cited by examiner

*Primary Examiner*—Jacob K. Ackun
(74) *Attorney, Agent, or Firm*—Andrus, Sceales, Starke & Sawall, LLP

(57) ABSTRACT

A tray package that is configured to facilitate angular display of the front display side of the package when the package is displayed along a generally vertical structure or surface, such as a clip strip, pegboard or the like. The tray is formed to include a compartment that contains packaged product. A sealing sheet such as film, foil or other lid stock is sealed to the tray and covers product packaged in the compartment. The back side of the formed tray extends angularly from a top edge portion and away from the front display side of the tray, thereby providing clearance for a vertical display structure and facilitating angular display of the front display panel of the package. The angularly extending portion of the back side preferably extends at an angle between 40°–65° with the front display panel on the package. Angular display of the front display panel of the package helps to enhance readability of the front display side of the package by prospective consumers at point-of-sale.

5 Claims, 2 Drawing Sheets

TRAY PACKAGING AND DISPLAY SYSTEM

FIELD OF THE INVENTION

This invention relates to packaging and display systems using a rigid or semi-rigid tray having compartments that are sealed with films, foils or other lid stock. More specifically, the invention relates to tray configurations that are especially designed to enhance viewing of a front display side of packaged products in point-of-purchase displays located in retail stores.

BACKGROUND OF THE INVENTION

One type of commonly used packaging for consumable items has a rigid or semi-rigid tray having one or more compartments for containing packaged products, such as snacks. For a snack such as chips and dip, the tray normally includes a compartment that contains the chips and a separate compartment that contains the dip. In many applications, the trays are made from thermo-forming polymeric material. In other cases, formed trays are made from metal (e.g. aluminum) or in some cases from paperboard. A sealing sheet such as film, foil or other lid stock is secured over the compartments, normally by thermal sealing or adhesive, to seal the compartments and keep the products within the compartments fresh.

These types of tray packages are designed so that the sealing sheet is secured to the front display side of the tray package. The sealing sheet often contains printing, and is sometimes transparent to allow prospective consumers to view contents within the compartments. Normally, these types of tray packages are displayed at the point-of-purchase in either horizontal or vertical arrangements on shelves, counters, or floors. When the packages are arranged in this fashion, exposure of the front display side of the package to the consumer is usually compromised. Also, the convenience of viewing the front display side of the tray package is a function of the height of the prospective consumer. For example, a tall person has difficulty reading a package which is displayed vertically and located at a low height. The tall person needs to bend down or back up to view the front display of the tray package. On the other hand, a shorter person may have difficulty reading the front display on horizontally arranged packages without leaning forward in order to gain a full view of the front display on the tray package.

Product marketability is likely to improve when the ability to read and study the front display panel is made more convenient for the consumer. The purpose of the invention is to improve the display and readability of the front display panel on tray packaging at the point-of-sale.

SUMMARY OF THE INVENTION

The invention is a tray packaging and display system that facilitates angular display of the front display side of tray packages at the point-of-sale. The package includes a formed tray having at least one compartment and a front display side and a back side. In accordance with the invention, at least a portion of the back side of the formed tray extends angularly from a top edge portion of the tray and away from the front display side. The angularly extending portion provides clearance for the tray package when the package is held at an angle within a point-of-purchase display such as a vertical clip strip or the like. In order to facilitate convenient viewing of the front display side by prospective consumers, the angle between the angularly extending portion of the back side and the front side display plane is typically within the range of 40°–65°, although angles between 15° to 80° will normally facilitate viewing of the front display side.

Various other features, objects and advantages of the invention will be apparent to those skilled in the art upon reviewing the drawings and reading the following description thereof. The invention can be implemented in various embodiments, two of which are shown in the accompanying drawings.

DETAILED DESCRIPTION OF THE INVENTION

Figure 1:
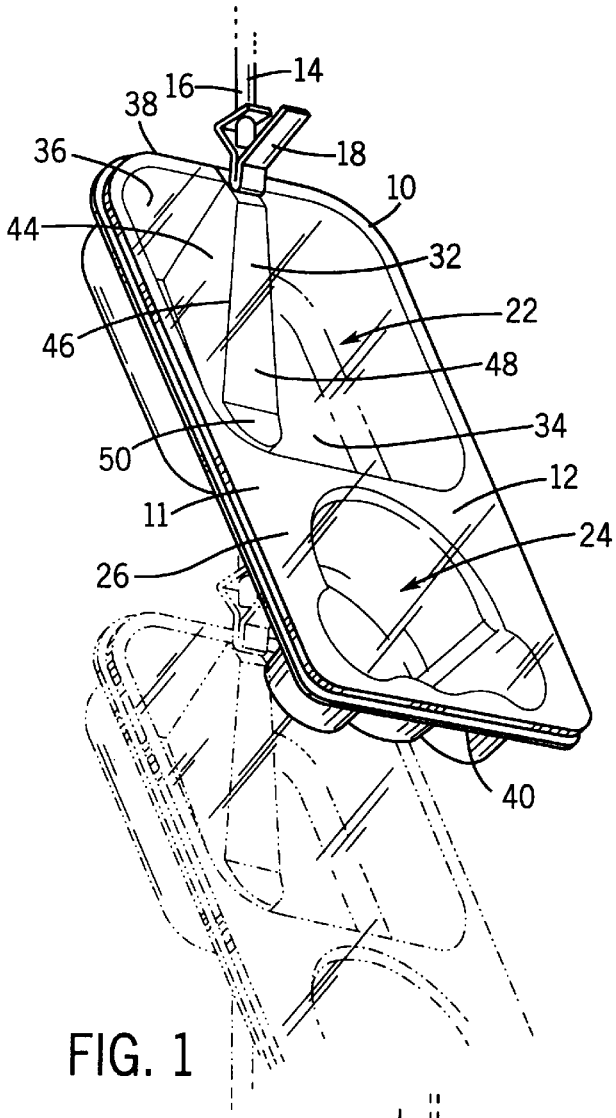
FIG. 1 is a partial perspective view illustrating a system for displaying packaged products in accordance with a first embodiment of the invention which uses a vertical clip strip point-of-purchase display structure.
Figure 2:
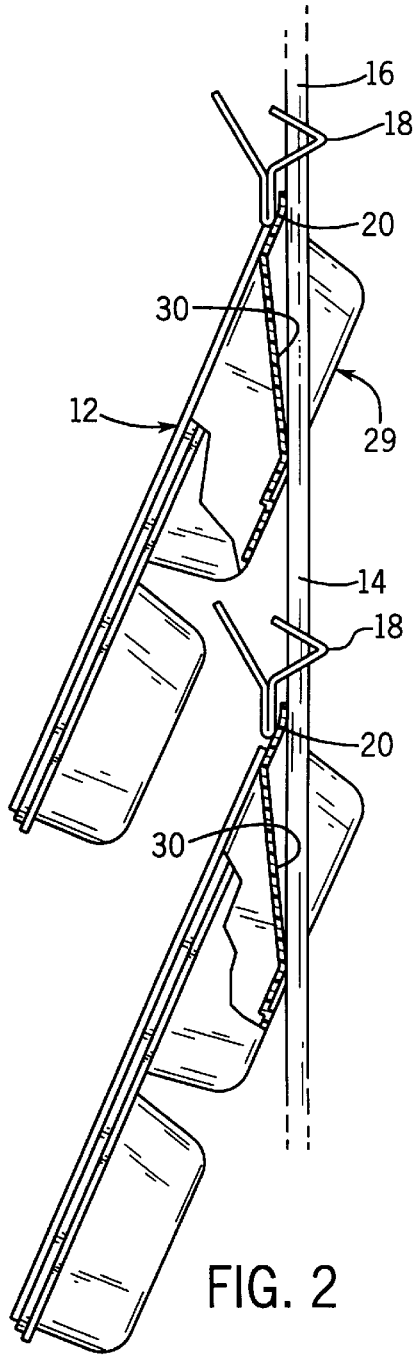
FIG. 2 is a side elevational view (with parts broken away) of the packaging display system illustrated in FIG. 1.
Figure 3:
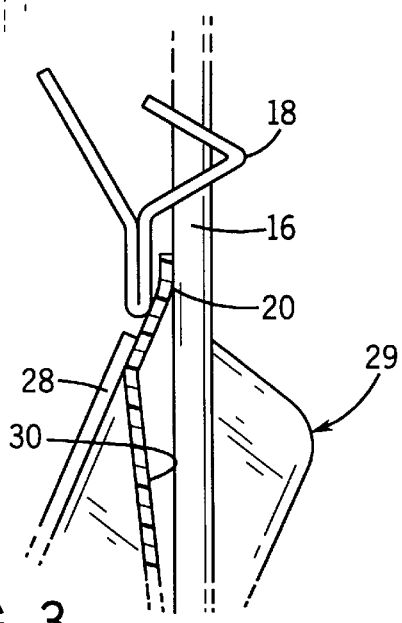
FIG. 3 is a detailed view of a part of FIG. 2 illustrating the securing of the tray package to the clip strip.
Figure 4:
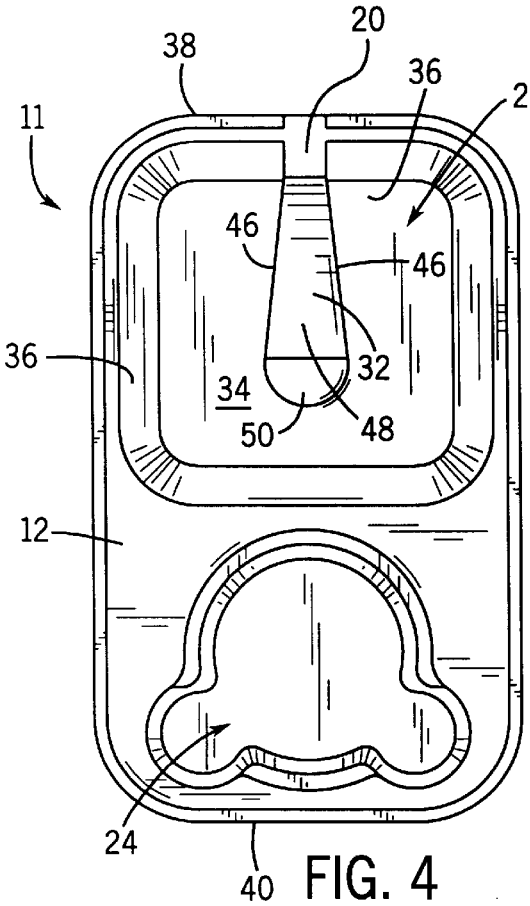
FIG. 4 is a top plan view of a formed tray manufactured in accordance with the first embodiment of the invention shown in FIG. 1.

FIGS. 1–4 show a tray package 10 in accordance with a first embodiment of the invention. As shown in FIGS. 1–3, the tray package 10 is configured to facilitate angular display of a front display side 12 when the package 10 is secured to a vertical clip strip 14. Clip strips 14 are conventional in the art, and typically comprise a vertical mounting pole or rack 16 with clips 18 mounted to the vertical mounting structure 16 in series and vertically displaced from one another along the mounting structure 16. The clips 18 secure a respective tray package 10 to the vertical clip strip 14 by holding a top portion 20 of the package 10 against the vertical pole 16.

The tray package 10 includes a formed tray 11 having a first compartment 22 and a second compartment 24. The first compartment 22 is designed to contain a first package product, and the second compartment 24 is designed to contain a second package product. While the invention does not require the use of separate compartments 22, 24, the use of separate compartments 22, 24 is effective for maintaining separation of items prior to use.

The front display side 12 of the tray 11 includes a substantially planar surface 26 surrounding the compartments 22, 24. A sealing sheet 28 (shown in exaggeration in FIG. 3) is secured to the substantially planar front surface 26 of the tray 11 to cover product items located in compartments 22, 24. Preferably, the sealing sheet is attached to the attachment area on the front planar surface 26 of the tray 11 via thermal sealing, or if necessary by adhesive.

The sealing sheet 28 covering the product compartments 22 and 24 can be any of the types of films, foils, composite materials, metalized Mylar, paper products, etc. that are typically used in the packaging industry. The specific type of material used for the sealing sheet 28 is dependent on the product items being packaged and the type of packaging machines used to package the product items. In some applications, it is desirable to print advertising, nutritional information or other types of information on the sealing sheet 28 that covers the compartments 22, 24. In other applications, it is desirable to provide a transparent sealing sheet (printed or unprinted) to allow the consumer to view product within the respective compartments 22, 24.

The tray 11 can be manufactured from various materials (for example plastic, metal, paperboard) when implementing the invention. In the preferred embodiment of the invention shown in the drawings, the tray 11 is made by thermoforming polymer stock. The specific type of polymer preferred for any given application depends on the product items being packaged as should be apparent to those skilled in the art. For example, when packaging chips in compartment 22 and dip in compartment 24, the preferred material for the tray is monostructure or composite structure thermoplastic, having a preformed thickness of 15–30 mils. For the above-described chip and dip trays 11, the invention can be implemented using conventional thermo-form-fill-seal machines (for example, RapidPak, Inc., Appleton, Wis.) or the trays 11 can be prefabricated and used in conventional tray sealer machines (for example, Ross, Midland, Va.).

In accordance with the invention, a portion 30 of a back side 29 of the tray 11 extends angularly from the top edge portion 20 of the tray 11 and away from the front display side 12. As shown best in FIGS. 2 and 3, the angular portion 30 on the back side 29 of the tray 11 provides clearance for the vertical structure 14 of the clip strip 16, and facilitates angular display of the front display side 12 of the package 10 when the package is hanging to the clip strip 14. In the embodiment shown in FIGS. 2 and 3, the angle between the top edge portion 20 and the angularly extending portion 30 is approximately 60°, although the invention should not be limited to such an angle. Angles in the range between 40° to 65° are best suited for facilitating enhanced angular display of the front display side 12 of the package 10, although angles in the range of 15° to 80° are sometimes practical and will typically improve viewing. Note also that the angularly extending portion 30 facilitates angular viewing of the front display side 12 of a plurality of packages 10 displaced vertically from one another and arranged in series on the clip strip 14.

The tray package 10 has a top display end 38 and a lower display end 40. The top edge portion 20 extends along the top display end 38. A central portion of the top edge portion 20 is configured to facilitate attachment to a clip strip 14. Alternatively, the top edge portion can contain a punch hole 42, FIG. 5, to facilitate hanging on a hanger. The compartment 22 in the tray 11 includes a bottom wall 34 that is generally parallel to the front display side 12. The compartment 22 also has sidewalls 36 that extend from the front display surface 12 to the bottom wall 34. The sidewall 36 should include a draft angle of at least 5°, preferably 10°, to facilitate efficient thermo-forming.

The compartment 22 in the tray 11 has a protrusion 32 which corresponds to the angularly extending portion 30 of the back side 29 of the tray 11. The protrusion 32 in the compartment 22 is defined by a pair of generally right triangular sidewalls 44, FIG. 1. The protrusion sidewalls 44 extend away from the sidewall 36 of the compartment 22 that is adjacent the top display end 38 of the tray 11. Each of protrusion sidewalls 44 includes a hypotenuse edge 46 that angles downward from the top edge portion 20 towards the bottom wall 34 of the compartment 22. A wall portion 48 spans between the hypotenuse edges 46 of the protrusion sidewalls 44. It is preferred that the spanning wall portion 48 span a greater distance between the hypotenuse edges 46 of the protrusion sidewalls 44 as the spanning wall portion 48 extends farther away from the top sidewall 36 of the compartment 22. As the spanning wall portion 48 of the protrusion 32 approaches the bottom wall 34 of the compartment 22, the spanning wall portion 48 meets a semi-circular base portion 50. The semicircular base portion 50 is at the location where the spanning wall portion 48 intersects with the bottom wall 34 of the compartment 22. The semi-circular base portion 50 may be raised slightly above the height of the bottom wall 34. The draft of the protrusion sidewalls 44 should be greater than 5° and preferably 10°. With a protrusion 32 designed as shown in the drawings, the vertical pole 16 for the clip strip 14 self-centers within the cavity on the back side 29 of the tray 11 corresponding to the protrusion 32.

As described in connection with FIGS. 1–4, a tray package 10 in accordance with the first embodiment of the invention is well-suited for use on vertical clip strips 14.

Figure 5:
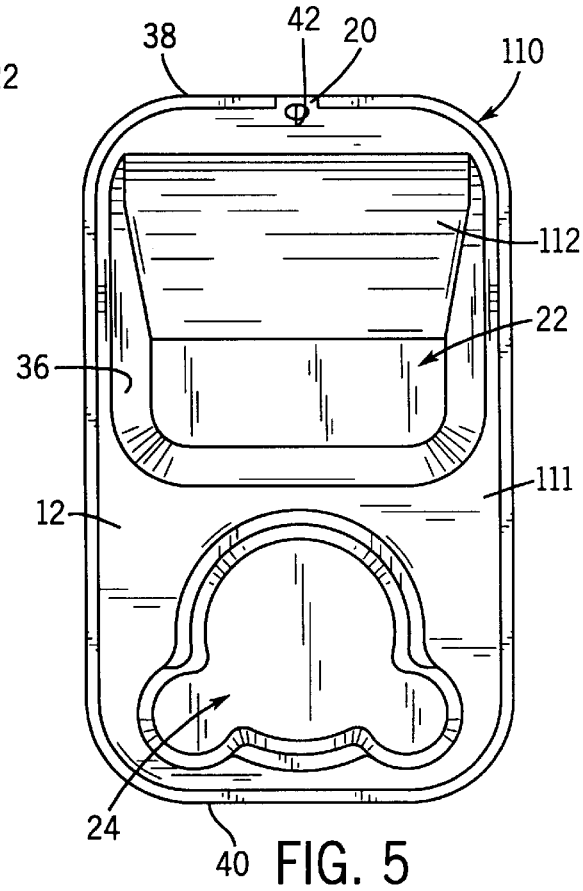
FIG. 5 is a top plan view of a tray formed in accordance with a second embodiment of the invention.
Figure 6:
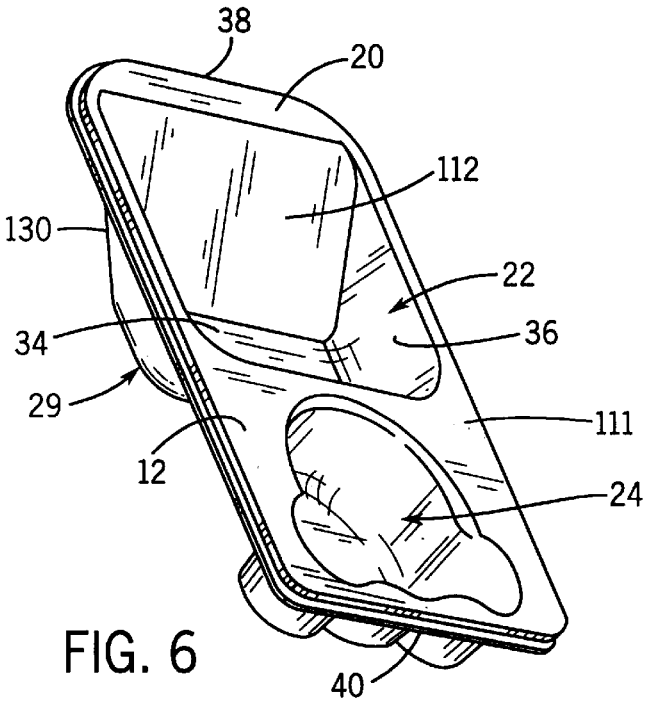
FIG. 6 is a perspective view of the formed tray made in accordance with the second embodiment of the invention as shown in FIG. 5.

FIGS. 5 and 6 show a tray package 110 in accordance with a second embodiment of the invention. The primary difference between the tray package 110 shown in FIGS. 5 and 6 and the tray package 10 shown in FIGS. 1–4 is the configuration of the top sidewall 112 in the compartment 22. In many other respects, the tray package 110 shown in FIGS. 5 and 6 is similar to the tray package 10 shown in FIGS. 1–4 and similar reference numerals are used where appropriate. Also, the materials and manufacturing considerations for the tray package 110 shown in FIGS. 5 and 6 are similar to that for the tray package 10 shown in FIGS. 1–4 as should be apparent to those skilled in the art.

In FIGS. 5 and 6, the angularly extending portion 130 of the backside 29 of the tray 111 extends transversely across the entire transverse width of the compartment 22. Likewise, the top sidewall 112 for the compartment 22 extends angularly from the adjacent top edge portion 22 to the bottom wall 34 in the compartment 22 along the entire transverse width of the compartment 22.

The embodiment of the invention shown in FIGS. 5 and 6 is particularly well-suited when displaying packages along a vertically disposed surface such as a wall or pegboard 131, FIG. 6. In such display applications, the angularly extending portion 130 of the back side 29 of the tray 110 needs to extend transversely across the entire width of the tray compartment 22 to provide for clearance along the entire surface of the back side 29.

In FIG. 5, a punch hole 42 is provided for hanging units on pegboard or the like. The embodiment of the invention shown in FIGS. 5 and 6 can also be used on clip strips or can be held in other manners such as on shelves, etc. For certain products, the embodiment shown in FIGS. 5 and 6 (with a complete angled back side wall) has been found preferable to the embodiment shown in FIGS. 1–4 (with protrusion 32) even when the tray package 110 is secured to a clip strip. Some products such as pretzels can damage the protrusion 32 shown in FIGS. 1–4 and compromise the integrity of the tray 11.

The invention has been described herein in connection with two preferred embodiments. Various alternatives and other embodiments are contemplated as being within the scope of the following claims which particularly point out and distinctly claim the subject matter regarded as the invention.

I claim:

1. A package for a product comprising:

a formed tray made of a rigid or semi-rigid material and including at least one compartment for containing a product, the formed tray having a front display side and a back side, the compartment being accessible from the front display side of the formed tray, and the front display side of the formed tray including a sealing sheet attachment area substantially lying in a front side plane and also substantially surrounding the compartment; and a sealing sheet covering the product packaged in the compartment and secured to the sealing sheet attachment area on the front display side of the formed tray, the sealing sheet comprising a flexible web;

wherein the formed tray further comprises:

a top display end;

a lower display end; and a top edge portion located adjacent the top display end; and wherein at least a portion of the back side of the formed tray extends angularly from the top edge portion and away from the front side plane, thereby facilitating angular display of the front display side of the package;

the angularly extending portion of the backside of the formed tray spans transversely for a portion of a transverse width of the compartment, but the angularly extending portion of the back side does not span transversely across an entire transverse width of the compartment;

the formed tray further comprises an angularly extending protrusion within the compartment corresponding to the angularly extending portion of the back side of the tray; and the protrusion has a pair of generally right triangular sidewalls extending from a top sidewall of the compartment adjacent the top edge portion of the tray, and a wall portion spanning between hypotenuse edges of the generally right triangular sidewalls, the spanning wall spanning a greater distance between the protrusion sidewalls as the spanning wall extends farther away from the top sidewall of the compartment adjacent the top edge portion of the tray.

2. A package as recited in claim 1 wherein the generally right triangular sidewalls are formed having a draft angle of at least 5°.

3. A package as recited in claim 1 wherein the protrusion has a pair of generally right triangular sidewalls extending from a top sidewall of the compartment adjacent the top edge portion of the tray, a wall portion spanning between hypotenuse edges of the generally right triangular sidewalls, and a semi-circular base portion at a location where the spanning wall intersects a floor wall of the compartment, the semi-circular base portion being raised above the floor of the compartment.

4. A system for displaying packaged products comprising:

a point-of-purchase-display structure for holding a plurality of packaged products, the display structure being adapted to hold packages in series arrangement vertically displayed from each other along a generally vertical structure; and a plurality of packages secured to the generally vertical structure, each package comprising:

a formed tray made of a rigid or semi-rigid material and including at least one compartment for containing a product the formed tray having a front display side and a back side, the compartment being accessible from the front display side of the formed tray, and the front display side of the formed tray including a sealing sheet attachment area substantially lying in a front side plane and substantially surrounding the compartment;

a sealing sheet covering product contained in the compartment and secured to the sealing sheet attachment area on the front display side of the formed tray, the sealing sheet comprising a flexible web;

wherein the formed tray further comprises a top display end and a lower display end, a top edge portion located adjacent the top display end and at least a portion of the back side, of the formed tray extends angularly from a portion of the top edge portion and away from the front side plane, thereby facilitating angular display and a view of the front display side of the package to prospective purchasers when packages are held by the point-of-purchase display structure in series arrangement and vertically displaced from each other; and further wherein the display structure is a clip strip which holds the packaged produces against a vertical surface of the clip strip using a series of vertically arranged clips.

5. A system for displaying packaged products comprising:

a point-of-purchase display structure for holding plurality of packaged products, the display structure being adapted to hold packages in series arrangement vertically displayed from each other along a generally vertical structure; and a plurality of packages secured to the generally vertical structure, each package comprising:

a formed tray made of a rigid or semi-rigid material and including at least one compartment for containing a product the formed tray having a front display side and a back side, the compartment being accessible from the front display side of the formed tray, and the front display side of the formed tray including a sealing sheet attachment area substantially lying in a front side plane and substantially surrounding the compartment;

a sealing sheet covering product contained in the compartment and secured to the sealing sheet attachment area on the front display side of the formed tray, the sealing sheet comprising a flexible web;

wherein the formed tray further comprises a top display end and a lower display end, a top edge portion located adjacent the top display end, and at least a portion of the back side of the formed tray extends angularly from a portion of the top edge portion and away from the front side plane, thereby facilitating angular display and a view of the front display side of the package to prospective purchasers when packages are held by the point-of-purchase display structure in series arrangement and vertically displaced from each other;

wherein the display structure is pegboard which holds packaged products on a vertical surface of the pegboard using pegboard hangers, and each of the packages further comprises a hole punched in the top edge portion of the tray to facilitate use of the pegboard hangers.

* * * * *

UNITED STATES PATENT AND TRADEMARK OFFICE

CERTIFICATE OF CORRECTION

PATENT NO. : 6,170,666 B1
DATED : January 9, 2000
INVENTOR(S) : Gary M. DesLAURIERS It is certified that error appears in the above-identified patent and that said Letters Patent is hereby corrected as shown below:

IN THE CLAIMS

CLAIM 4, column 5, line 63, after "product" insert -- , --; CLAIM 4, column 6, line 12, after "end" insert -- , --; CLAIM 4, column 6, line 13, after "side" delete " , "; CLAIM 5, column 6, line 25, after "holding" insert -- a --; CLAIM 5, column 6, line 34, after "product" insert -- , --.

Signed and Sealed this

Fifteenth Day of May, 2001

*Attest:*

*Attesting Officer*

NICHOLAS P. GODICI

*Acting Director of the United States Patent and Trademark Office*